US009545145B2

(12) United States Patent
Gash

(10) Patent No.: US 9,545,145 B2
(45) Date of Patent: Jan. 17, 2017

(54) ULTRA LIGHT ADJUSTABLE THERMAL SYSTEM FOR HAMMOCKS

(71) Applicant: Alexander McKee Gash, Lawrenceburg, KY (US)

(72) Inventor: Alexander McKee Gash, Lawrenceburg, KY (US)

( * ) Notice: Subject to any disclaimer, the term of this patent is extended or adjusted under 35 U.S.C. 154(b) by 458 days.

(21) Appl. No.: 14/271,642

(22) Filed: May 7, 2014

(65) Prior Publication Data

US 2014/0345049 A1 Nov. 27, 2014

Related U.S. Application Data

(60) Provisional application No. 61/855,747, filed on May 23, 2013, provisional application No. 61/855,748, filed on May 23, 2013.

(51) Int. Cl.
*A45F 3/22* (2006.01)
*A45F 4/08* (2006.01)

(52) U.S. Cl.
CPC .. *A45F 3/22* (2013.01); *A45F 4/08* (2013.01)

(58) Field of Classification Search
CPC ..... A45F 3/00; A45F 3/22; A45F 3/24; A45F 4/02; A45F 4/08; A47C 17/64; A47C 17/78; A47C 17/84; A47G 9/02; A47G 9/0207; A47G 9/0215; A47G 9/0223; A47G 9/023
See application file for complete search history.

(56) References Cited

U.S. PATENT DOCUMENTS

| | | | | |
|---|---|---|---|---|
| 3,675,256 | A | 7/1972 | Tallarico et al. | |
| 3,878,574 | A * | 4/1975 | Erickson | A47G 9/086 5/413 R |
| 4,001,902 | A * | 1/1977 | Hall | A45F 3/22 5/121 |
| 4,125,909 | A | 11/1978 | Jacobson | |
| 4,686,720 | A * | 8/1987 | Newell | A45F 3/22 5/121 |
| 5,072,465 | A * | 12/1991 | Lyons, Jr. | A47G 9/086 135/90 |
| 5,913,772 | A | 6/1999 | Clark | |
| 6,185,763 | B1 | 2/2001 | Hennessy | |
| 6,421,851 | B2 | 7/2002 | Hennessy | |
| 6,711,763 | B2 | 3/2004 | Batchelder et al. | |

(Continued)

OTHER PUBLICATIONS

Ultralight insulated cuben hammock, Hammock Forums, Apr. 30-Jun. 1, 2012, www.hammockforums.net/forum/showthread.php?t=51940 - /showthread.php?t=51940&page=4.

(Continued)

*Primary Examiner* — David E Sosnowski
*Assistant Examiner* — Rahib Zaman
(74) *Attorney, Agent, or Firm* — Stoll Keenon Ogden PLLC; Rebecca Ann Krefft

(57) ABSTRACT

A hammock system according to one example embodiment includes an upper hammock bed with a length, a lower hammock bed with a length greater than the length of the upper hammock bed, a thermal insulating blanket configured to connect to the lower hammock bed, a gap between the upper hammock bed and the thermal insulating blanket, and an adjuster for altering the size of the gap between the upper hammock bed and the thermal insulating blanket. The lower hammock bed is configured to connect to the upper hammock bed.

8 Claims, 12 Drawing Sheets

(56) References Cited

U.S. PATENT DOCUMENTS

| | | | | |
|---|---|---|---|---|
| 7,699,068 | B2 * | 4/2010 | Helsdon | A45F 3/22 135/90 |
| 2001/0025390 | A1 | 10/2001 | Hennessy | |
| 2002/0042951 | A1 * | 4/2002 | Hennessy | A45F 3/22 5/120 |
| 2005/0188460 | A1 * | 9/2005 | O'Brien | A45F 3/52 5/121 |
| 2005/0262633 | A1 * | 12/2005 | Haleem | A47G 9/066 5/482 |
| 2006/0185085 | A1 * | 8/2006 | Brenner | A47G 9/086 5/413 R |
| 2007/0079442 | A1 * | 4/2007 | Stoll | A45F 3/24 5/120 |
| 2009/0065036 | A1 * | 3/2009 | Johnson | E04H 15/04 135/95 |
| 2009/0165205 | A1 | 7/2009 | Hennessy | |

OTHER PUBLICATIONS

Yet another question about sewing into the hammock body, Hammock Forums, Mar. 29-Apr. 24, 2012, www.hammockforums.net/forum/showthread.php?t=50071 - /showthread.php?t=50071&page=2.

Cuben hammock w/built in dual differential cut asym karo step winter UQ—first ever?, Hammock Forums, Sep. 28-Dec. 17, 2011, www.hammockforums.net/forum/showthread.php?t=39831.

Integrated insulation.., Hammock Forums, Apr. 10-May 14, 2012, www.hammockforums.net/forum/showthread.php?t=50791 - /showthread.php?t=50791&page=4.

Clarkish,pocketed,hammock with intergrated sock, Hammock Forums, Mar. 6-Apr. 24, 2012, www.hammockforums.net/forum/showthread.php?t=48581 - /showthread.php?t=48581 &page=3.

Hammock/UQ all-in-one?, Hammock Forums, Feb. 22-Feb. 25, 2012, www.hammockforums.net/forum/showthread.php?t=47721 - /showthread.php?t=47721 &page=3.

DownHammock Version 2, tothewoods.net, 2006, http://www.tothewoods.net/HomemadeGearDownHammock2.html.

DownHammock Version 1, tothewoods.net, 2006, http://www.tothewoods.net/HomemadeGearDownHammock.html.

WarmHammock Version 2, tothewoods.net, 2006, http://www.tothewoods.net/HomemadeGearWarmHammock2.html.

WarmHammock Version 1, tothewoods.net, 2006, http://www.tothewoods.net/HomemadeGearWarmHammock.html.

Risk's Warm Hammock, www.imrisk.com, 2004, http://www.imrisk.com/hammock/warmhammock.htm.

www.dplightweightbackpackinggear.com, http://www.dplightweightbackpackinggear.com/dp-bedroom.html.

www.madtree.fi, http://www.madtree.fi/products/tarseer.html.

* cited by examiner

100

116
118
102
114
122

128
124
126
125
128
124
120

ULTRA LIGHT ADJUSTABLE THERMAL SYSTEM FOR HAMMOCKS

CROSS-REFERENCE TO RELATED APPLICATIONS

This application claims priority to U.S. Provisional Application No. 61/855,747, entitled "Ultra light gathered end hammock with adjustable thermal system" and filed on May 23, 2013, and U.S. Provisional Application No. 61/855,748, entitled "Ultra light adjustable all weather thermal system for hammocks" and filed on May 23, 2013, which are incorporated by reference herein in their entirety.

BACKGROUND

1. Field of the Disclosure

The present invention relates to systems and methods for hammocks.

2. Description of the Related Art

For backpacking, hammocks are a lightweight, more versatile and comfortable alternative to sleeping on the ground. Sleeping on the ground generally requires a backpacker to carry a tent, sleeping bag, sleeping pad or mattress and ground sheet. In addition to being less weight for the backpacker to carry, hammocks free the backpacker from insects, snakes and other ground dwelling animals, and also keep the backpacker off wet, sloping and rocky ground.

Although a number of lightweight camping hammocks are available for campers and backpackers, they suffer from a variety of shortcomings. They do not address many of the issues of integrated insulation. With a conventional sleeping bag, a camper's body compresses the underlying insulation causing the insulation to lose much of its insulation properties. Sleeping pads or mattresses often insulate the bottom of the user outside a hammock, but often are rigid and do not conform well to a hammock. Attaching insulation directly to the underside of the hammock can help decrease compression, but when the camper lies in the hammock the hammock material typically stretches whereas the material holding the insulation against the bottom of the hammock does not, again resulting in compression of the insulation with a reduction in insulation properties. In addition, when the insulation is fully attached to the hammock bed, it is difficult to control the temperature within the hammock so the camper may become too warm. Thus, when the insulation is fully attached and not adjustable, the camper typically needs multiple hammocks for camping in different seasons.

Another disadvantage relating to completely enclosing the hammock in a sleeping bag or sleeping cocoon is that significantly more weight is usually required to fully encase the camper than is necessary to keep the camper comfortable. In addition, camping in inclement weather typically requires the backpacker carry a tarp, guylines and stakes, which add significant extra weight.

Accordingly, it will be appreciated that systems and methods for hammocks that are lightweight and adjustable and that minimize insulation compression are desired.

SUMMARY

A hammock system according to one example embodiment includes an upper hammock bed with a length, a lower hammock bed with a length greater than the length of the upper hammock bed, a thermal insulating blanket configured to connect to the lower hammock bed, a gap between the upper hammock bed and the thermal insulating blanket, and an adjuster for altering the size of the gap between the upper hammock bed and the thermal insulating blanket. The lower hammock bed is configured to connect to the upper hammock bed.

A hammock system according to another example embodiment includes an upper hammock bed with a length, a lower hammock bed with a length greater than the length of the upper hammock bed, a first side, and a second side, a thermal insulating blanket connected to the lower hammock bed, a gap between the upper hammock bed and the thermal insulating blanket, and an adjuster for altering tension in the first and second sides of the lower hammock bed and altering the size of the gap between the upper hammock bed and the thermal insulating blanket. The lower hammock bed is connected to the upper hammock bed. The gap has a height of at least one inch when the tension in the first and second sides of the lower hammock bed is reduced and of less than one inch when the tension in the first and second sides of the lower hammock bed is increased.

A hammock system according to another example embodiment includes an upper hammock bed with a length, a lower hammock bed with a length greater than the length of the upper hammock bed, a first side, and a second side, a thermal insulating blanket connected to the lower hammock bed, a plurality of loops for connecting the thermal insulating blanket to the lower hammock bed, a plurality of cords connected to the thermal insulating blanket, a gap between the upper hammock bed and the thermal insulating blanket, and an adjuster for altering tension in the first and second sides of the lower hammock bed and altering the size of the gap between the upper hammock bed and the thermal insulating blanket. The lower hammock bed is connected to the upper hammock bed, the loops are connected to the lower hammock bed, and each cord is for connecting to one of the loops connected to the lower hammock bed. The gap has a height of at least one inch when the tension in the first and second sides of the lower hammock bed is reduced and of less than one inch when the tension in the first and second sides of the lower hammock bed is increased.

BRIEF DESCRIPTION OF THE DRAWINGS

The above-mentioned and other features and advantages of the various embodiments, and the manner of attaining them, will become more apparent and will be better understood by reference to the accompanying drawings.

FIG. 8A top plan view of a weather cover of the hammock system according to one example embodiment;

FIG. 9A top plan view of a weather cover according to one example embodiment;

DETAILED DESCRIPTION

Figure 1:
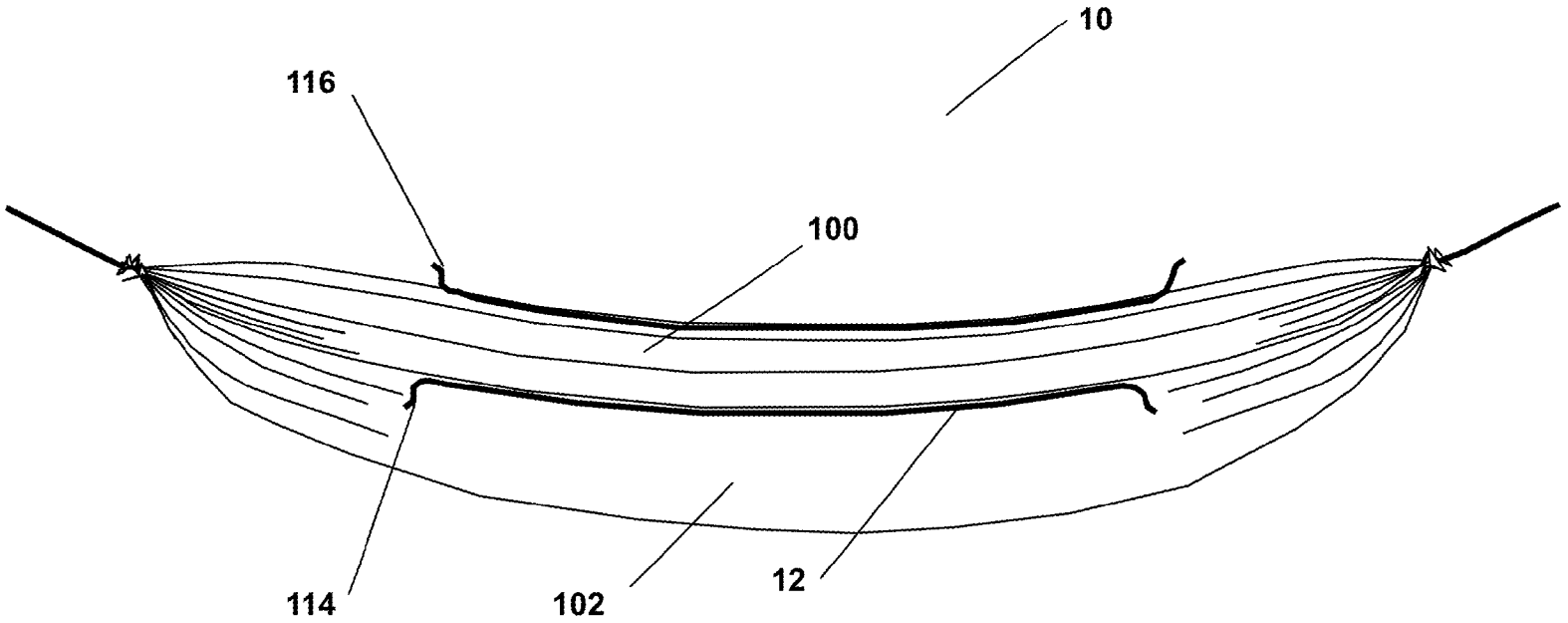
FIG. 1 is a perspective view of a hammock system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings and mountings. In addition, the terms "connected" and "coupled" and variations thereof are not restricted to physical or mechanical connections or couplings.

Turning now to the drawings, and more particularly to FIG. 1, an example embodiment of a hammock system 10 is illustrated. The hammock system 10 includes an upper hammock bed 100 on which a user may lie, a lower hammock bed 102, and a thermal insulating blanket 120 (shown in FIG. 2C). The lower hammock bed 102 has a length that is greater than the length of the upper hammock bed 100 such that a gap is formed between the upper hammock bed 100 and the thermal insulating blanket 120.

In multiple embodiments, the hammock system 10 includes an adjuster 12 to alter the size of the gap between the upper hammock bed 100 and the thermal insulating blanket 120. In some embodiments, the gap has a height of at least one inch when tension in the side edges of the lower hammock bed 102 is reduced and of less than one inch when the tension in the side edges of the lower hammock bed 102 is increased.

In some embodiments, the adjuster 12 includes shock cords 114 and 116 that run along the side edges of the lower hammock bed. In some embodiments, tension in shock cords 114 and 116 may be adjusted to decrease the size of or eliminate the gap between the upper hammock bed 100 and the thermal insulating blanket to increase warmth. In some embodiments, tension in shock cords 114 and 116 may be adjusted to increase the size of the gap to increase air flow and prevent over heating.

Figures 2A, 2B, 2C:
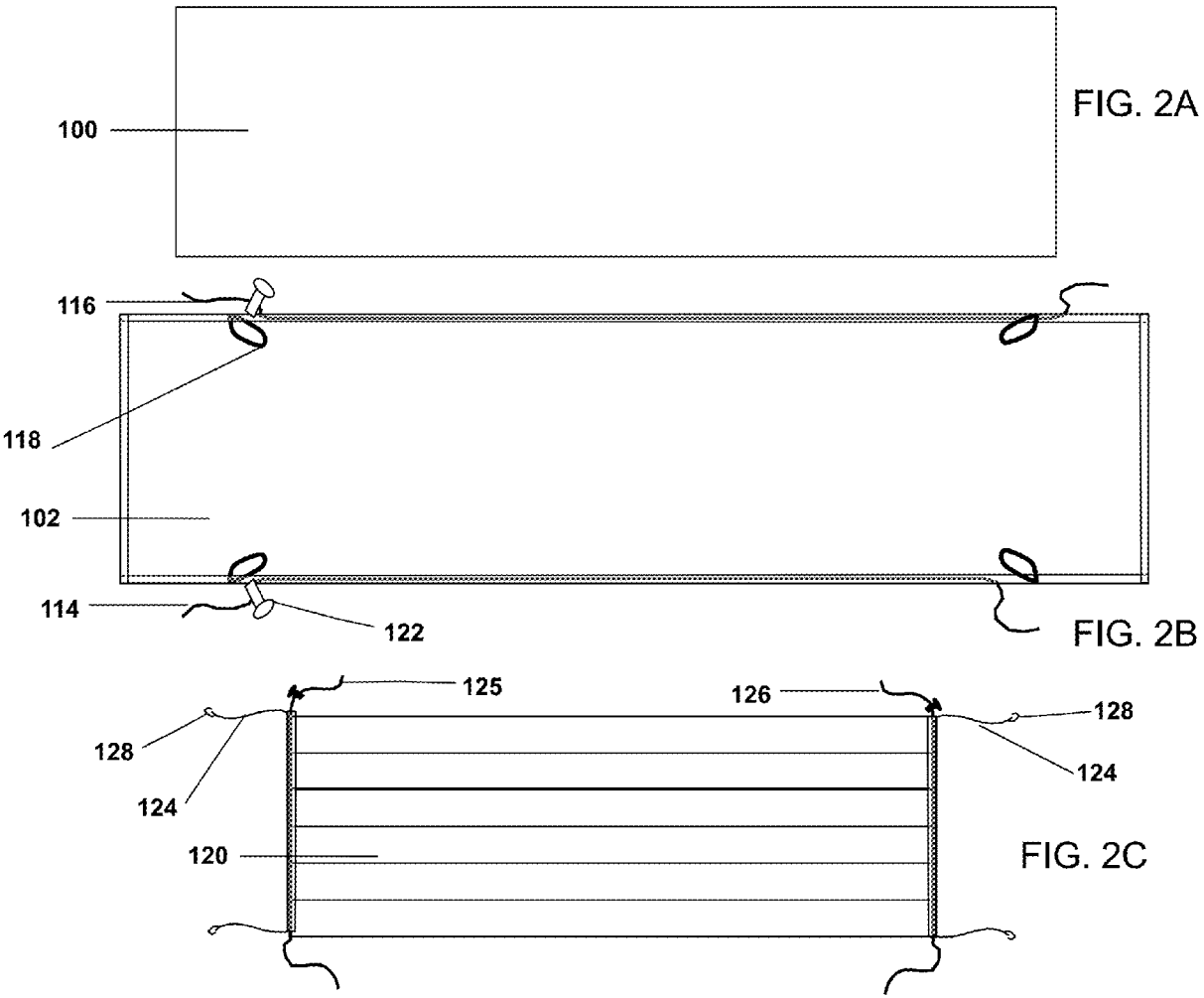
FIG. 2A is a top plan view of an upper hammock bed of the hammock system according to one example embodiment.
FIG. 2B is a top plan view of a lower hammock bed of the hammock system according to one example embodiment.
FIG. 2C is a top plan view of a thermal insulating blanket of the hammock system according to one example embodiment.

With reference to FIG. 2A, the upper hammock bed 100 is shown. The upper hammock bed 100 may be made of a sheet of light weight material of sufficient strength and resilience to withstand an appropriate load and repeated use under varying conditions. In some embodiments, the upper hammock bed 100 may be made from nylon, polyester, cotton, silk, or other such natural or man-made fabric with similar qualities. The upper hammock bed 100 may be made in a variety of sizes and shapes, such as a rectangle, square, or parallelogram, for example. In some embodiments, the upper hammock bed 100 may be at least about 3 feet wide and at least about 7 feet long for an adult camper. For example, in certain embodiments, the upper hammock bed may be made from a 5 feet by 8 feet rectangle of rip-stop nylon.

With regard to FIG. 2B, the lower hammock bed 102 is shown. The lower hammock bed 102 may be made of a sheet of light weight material of sufficient strength and resilience to withstand an appropriate load and repeated use under varying conditions. In some embodiments, the lower hammock bed 102 may be made from nylon, polyester, cotton, silk, or other such natural or man-made fabric with similar qualities. In some embodiments, the lower hammock bed 102 may be made from the same material as the upper hammock bed 100. The lower hammock bed 102 may be made in a variety of sizes and shapes, such as a rectangle, square, or parallelogram, for example. In some embodiments, the lower hammock bed 102 may be approximately the same width as the upper hammock bed 100 but may be at least about 16 inches longer than the upper hammock bed 100. For example, the lower hammock bed may be about 5 feet wide and about 10 feet long.

In multiple embodiments, the shock cords 114 and 116 are located along the side edges of the lower hammock bed 102. In some embodiments, the shock cord 114 is sewn in a seam along one side edge of the lower hammock bed 102 and the shock cord 116 is sewn in a seam along another side edge of the lower hammock bed 102. In some embodiments, tension in the shock cords 114 and 116 may be adjusted using cord locks 122 or in some other manner, such as using a knot or other hardware, for example.

In some embodiments, loops 118, to which the thermal insulating blanket may be attached, are connected to the lower hammock bed 102. In some embodiments, the loops 118 may be attached to the lower hammock bed 102, such as with an adhesive, thread, or staples, for example. In other embodiments, the loops 118 may be integrally formed with the lower hammock bed 102. In certain embodiments, one loop 118 may be sewn near each side edge of the lower hammock bed 102 about 12 inches from the head end of the lower hammock bed 102, and one loop 118 may be sewn near each side edge of the lower hammock bed 102 about 12 inches from the foot end of the lower hammock bed 102. In certain embodiments, additional loops may be attached to the lower hammock bed 102, such as two loops spaced about equally between each set of the loops 118 near the side edges of the lower hammock bed, for example. The loops 118 may be made of a strong natural or synthetic material. In some embodiments, the loops 118 are made from grosgrain.

Turning to FIG. 2C, the thermal insulating blanket 120 is illustrated. The thermal insulating blanket 120 may be made in a variety of sizes and shapes, such as a rectangle, square, or parallelogram, for example. In certain embodiments, the thermal insulating blanket 120 may be approximately 7 feet long for cold weather camping. In other embodiments, the thermal insulating blanket 120 may be about four feet long to reduce weight for warm weather camping. In some embodiments, a cord 124 is attached to each corner of the thermal insulating blanket 120 to attach the thermal insulating blanket 120 to the loops 118 connected to the lower hammock bed 102. The cords 124 may be attached to the thermal insulating blanket 120 with an adhesive, thread, or staples, for example. In some embodiments, each cord 124 is tied to one of the loops 118. In certain embodiments, each cord 124 has a clip 128 to attach to one of the loops 118.

In multiple embodiments, the hammock system 10 includes a thermal insulating blanket adjuster to alter tension in the ends of the thermal insulating blanket 120. In some embodiments, the thermal insulating blanket adjuster includes a shock cord 125 located near the head end of the thermal insulating blanket 120 and a shock cord 126 located near the foot end of the thermal insulating blanket 120. In some embodiments, the shock cord 125 may be sewn in a seam at the head end of the thermal insulating blanket, and the shock cord 126 may be sewn in a seam at the foot end of the thermal insulating blanket. In some embodiments, tension in the shock cord 125 at the head end of the thermal insulating blanket 120 may be increased to reduce air flow near the head of the user or may be reduced to increase air flow as needed for comfort. In some embodiments, tension in shock cord 126 at the foot end of the thermal insulating blanket may be increased to reduce air flow near the feet of the user or may be reduced to increase air flow as needed for comfort.

Figure 3:
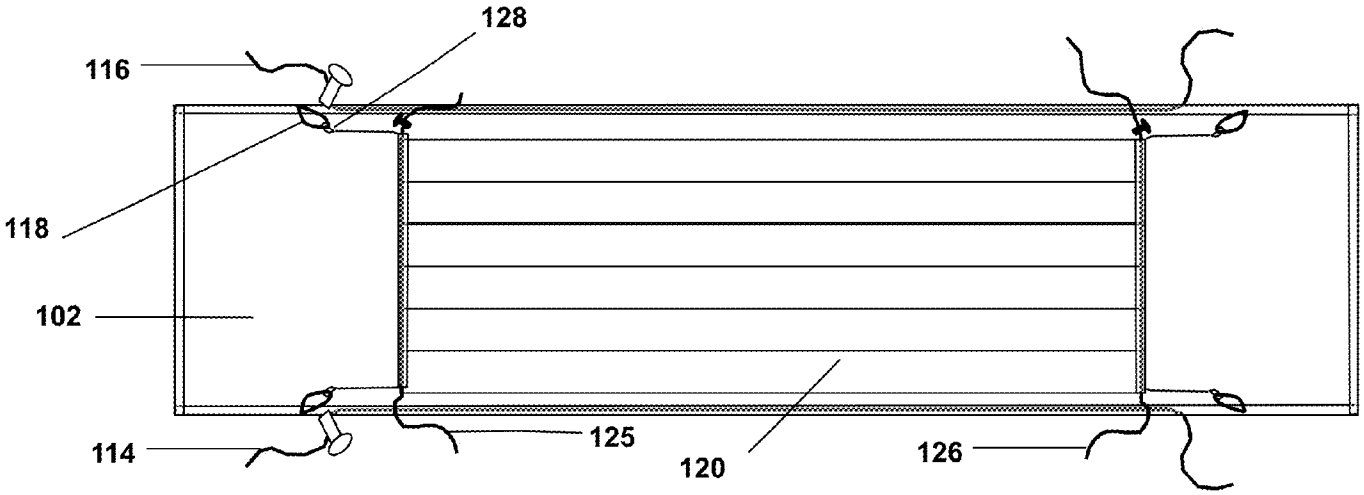
FIG. 3 is a top plan view of the lower hammock bed and the thermal insulating blanket according to one example embodiment.

As shown in FIG. 3, in some embodiments, the thermal insulating blanket 120 is secured to the lower hammock bed 102 by attaching the cords 124 with clips 128 on each corner of the thermal insulating blanket 120 to the loops 118 on the lower hammock bed 102. In some embodiments, the thermal insulating blanket 120 is secured to the lower hammock bed 102 by tying the cords 124 to the loops 118.

In multiple embodiments, the head end of the upper hammock bed is aligned with the head end of the lower hammock bed 102. In multiple embodiments, the foot end of the upper hammock bed is aligned with the foot end of the lower hammock bed 102. In some embodiments, the upper hammock bed may be attached to the lower hammock bed 102, such as with an adhesive, thread, or staples, for example. In other embodiments, the upper hammock bed may be integrally formed with the lower hammock bed 102.

In some embodiments, the head end of the upper hammock bed is aligned with the head end of the lower hammock bed 102 and they are sewn together. In some embodiments, the foot end of the upper hammock bed is aligned with the food end of the lower hammock bed 102 and they are sewn together. In some embodiments, the upper hammock bed may also be sewn to the lower hammock bed 102 approximately 8 inches from the head end of the upper hammock bed and lower hammock bed 102, and may also be sewn to the lower hammock bed 102 approximately 8 inches from the foot end of the upper hammock bed and lower hammock bed 102. In some embodiments, the ends are then gathered and tied in the usual manner to form a gathered end style hammock. In other embodiments, the hammock system may include ties for attaching the hammock system to a support or anchor. The ties may be attached to the upper hammock bed and lower hammock bed, such as with an adhesive, thread, or staples, for example. In certain embodiments, there may be three, four, or five ties, for example.

Figure 4:
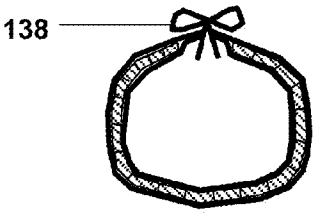
FIG. 4 is an end section view of the upper hammock bed, the lower hammock bed, and the thermal insulating blanket according to one example embodiment.

As shown in FIG. 4, in some embodiments, the edges of the lower hammock bed may be drawn together to enclose the user. For example, the user may be enclosed during cold weather camping for additional warmth. In some embodiments, methods, such as ties 138, snaps, Velcro, or hooks, for example, may be used to enclose the user.

Figure 5:
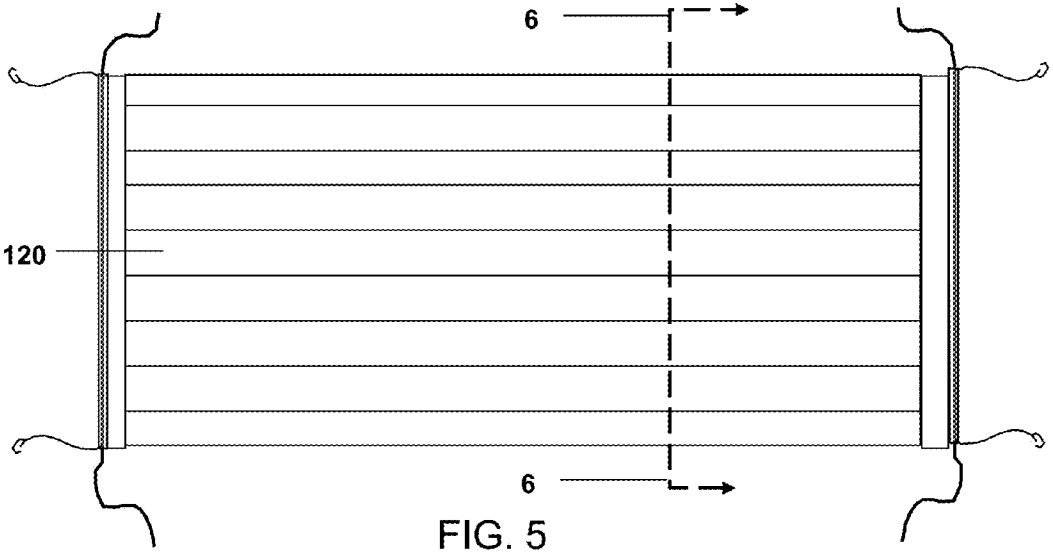
FIG. 5 is a top plan view of the thermal insulating blanket according to one example embodiment.
Figure 6:
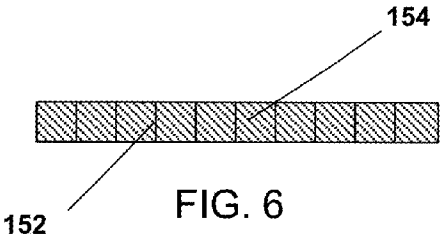
FIG. 6 is a cross sectional view of the thermal insulating blanket in FIG. 5 taken along line 6-6.

Turning to FIG. 5, the thermal insulating blanket 120 is illustrated. A cross sectional view of the thermal insulating blanket 120 in FIG. 5 taken along line 6-6 is shown in FIG. 6. In some embodiments, baffles 152 between top and bottom surfaces of the thermal insulating blanket prevent insulation 154 from clumping or shifting during use. The thermal insulation blanket may be made with different width or height baffles 152 and different thicknesses for different temperature ratings. For example, the thermal insulation blanket may be approximately one inch thick and rated for 40° F. camping or may be approximately four inches thick and rated for 0° F. camping.

The top and bottom surfaces of the thermal insulating blanket may be made of a light weight fabric, such as nylon, polyester, or other synthetic or natural woven fiber, for example. The baffles 152 may be made of a mesh material to reduce weight and to allow the passage of air between the baffles while keeping the insulation in place. The insulation 154 may be made of a material, such as down, feathers, fleece, open-celled foam, or a spun insulation, for example. In some embodiments, the insulation 154 may be made of sheets of material. In certain embodiments, the sheets of material are quilted or sewn-through to prevent the insulation 154 from clumping or shifting during use.

Figure 7:
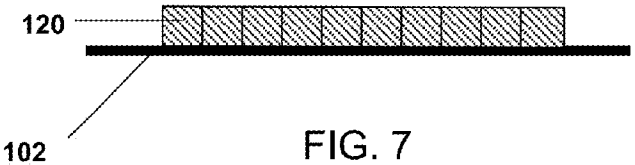
FIG. 7 is an end section view of the thermal insulating blanket according to one example embodiment.

In some embodiments, the thermal insulation blanket 120 may be formed as part of the lower hammock bed 102. As illustrated in FIG. 7, the lower hammock bed 102 may form the bottom surface of the thermal insulation blanket 120. In other embodiments, the lower hammock bed 102 may form the top surface or the top surface and the bottom surface of the thermal insulation blanket 120.

Series of the hammock system with different temperature ratings may be made by forming the thermal insulation blanket with different thicknesses on the lower hammock bed 102. In some embodiments, the user may use the hammock system with a thermal insulation blanket rated for 40° F. for mild weather camping and may attach a second thermal insulation blanket to the lower hammock bed loops 118 (shown in FIG. 2B) for cold weather camping.

Figure 8A:
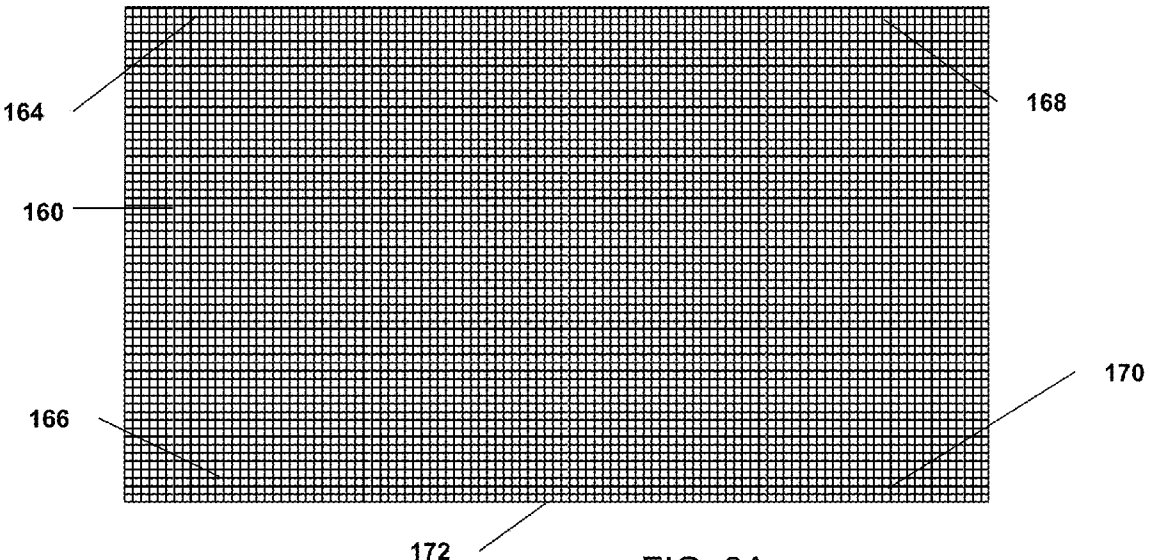

In some embodiments, the hammock system may include a weather cover 160 for protection from weather or insects as illustrated in FIG. 8A. The weather cover 160 may be mosquito netting for protection from insects, a water resistant material for protection from dew, or a water proof material for protection from precipitation, for example. The weather cover 160 may be made in a variety of sizes and shapes, such as a rectangle, square, or parallelogram, for example. In certain embodiments, the weather cover 160 may be made of a rectangular sheet of material approximately as long as the upper hammock bed and about thirty six inches wide. Two sides 164 and 166 at the head end of the weather cover 160 may be sewn together or attached together with a zipper, staples, an adhesive, or some other method. Two sides 168 and 170 at the foot end of the weather cover 160 may be sewn or attached together with a zipper, staples, an adhesive, or some other method. In some embodiments, sides of the weather cover 160 in the middle of the weather cover are not attached together, to form an ingress and egress opening 172 for the user.

Figure 8C:
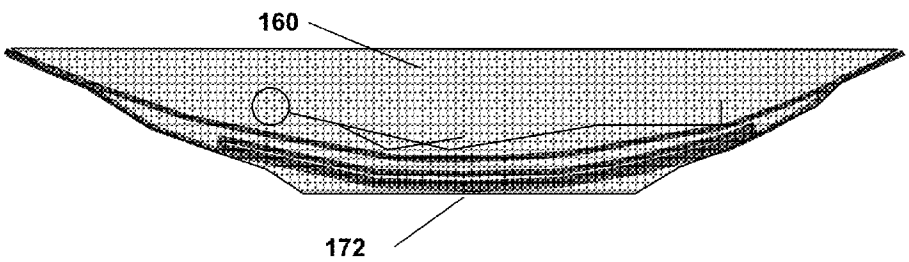
FIG. 8C is a side elevation view of a weather cover according to one example embodiment.
Figure 8B:
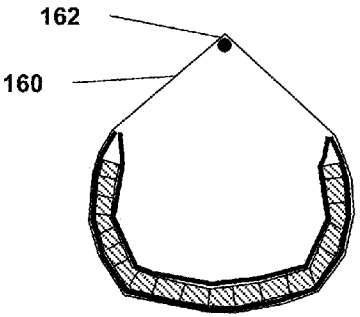
FIG. 8B is an end section view of a weather cover according to one example embodiment.

In some embodiments, the weather cover 160 may be in the form of a tube with a slit along the bottom of the tube. As shown in FIG. 8C, the hammock beds may be placed inside the weather cover 160 prior to securing the hammock beds to supports. In certain embodiments, the head end of the weather cover 160 may be gathered around the head end of a gathered end style hammock and tied with the head end of the hammock to one support. In such embodiments, the foot end of the weather cover 160 may be gathered around the foot end of the gathered end style hammock and tied with the foot end of the hammock to a second support. As shown in FIG. 8B, an optional ridge line 162 to help support the top of the weather cover 160 may be added.

Returning to FIG. 8C, in certain embodiments, the opening 172 may located at approximately the center of the underside of the lower hammock bed. The user may enter through the opening 172 to get into the hammock. In certain embodiments, the body weight of the user lying in the hammock system pushes the bottom of the lower hammock bed against the weather cover eliminating openings through which insects or precipitation might enter.

Figure 9A:
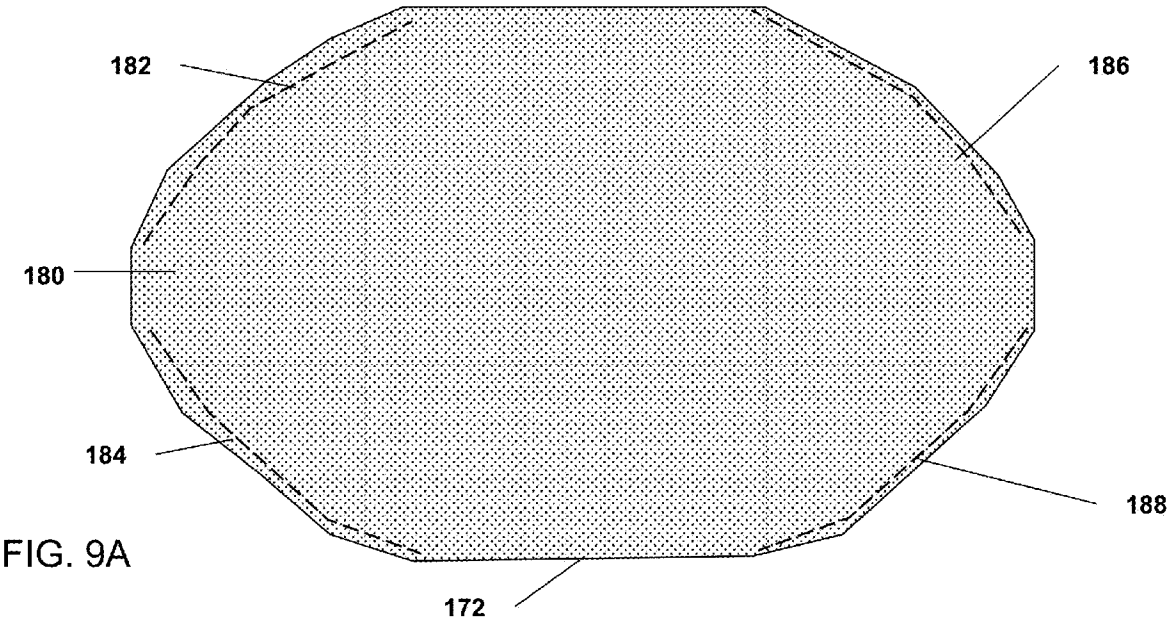

Referring now to FIG. 9A, a weather cover 180 with a portion of the corners of the weather cover 180 removed to reduce weight is illustrated. Sides 182 and 184 at the head end of the weather cover 180 may be sewn together or attached together with a zipper, staples, an adhesive, or some other method. Sides 186 and 188 at the foot end of the weather cover may be sewn together or attached together with a zipper, staples, an adhesive, or some other method. In some embodiments, the opening 172 may be in the middle of the weather cover 180 for ingress and egress.

Figure 9B:
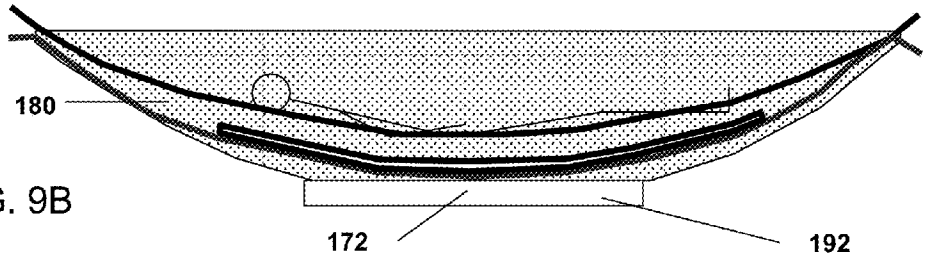
FIG. 9B is a side elevation view of a weather cover according to one example embodiment.

As shown in FIG. 9B, prior to hanging the hammock beds, the hammock beds may be placed inside the weather cover 180 through the opening 172. In certain embodiments, the head end of the weather cover 180 may be gathered and tied with the head end of a gathered end style hammock and the foot end of the weather cover 180 may be gathered and tied with the foot end of the hammock.

A rain collar 192 may be added around the opening 172 to prevent precipitation from wetting the bottom of the hammock system, which may be exposed through the opening 172 when the user is lying in the hammock.

Figure 10:
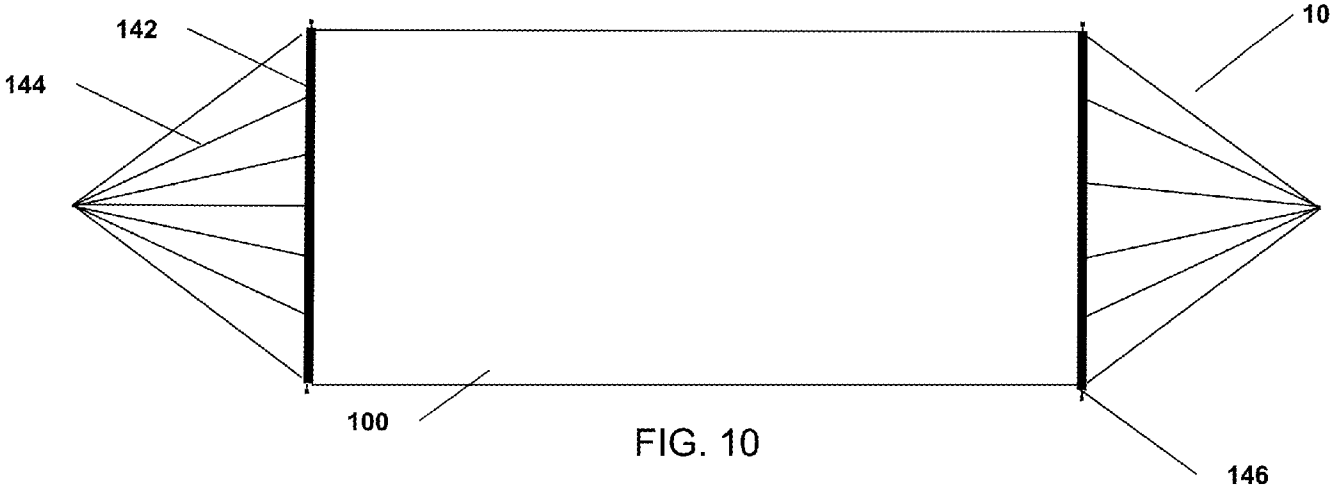
FIG. 10 is a top plan view of a hammock system according to one example embodiment.
Figure 11:
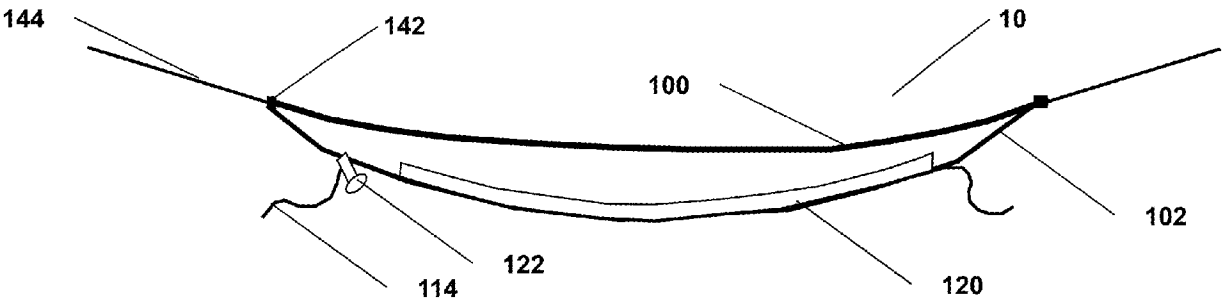
FIG. 11 is a side elevation view of the hammock system shown in FIG. 10.

Turning now to FIGS. 10 and 11, another example embodiment of the hammock system 10 with the upper hammock bed 100, lower hammock bed 102, and thermal insulating blanket 120 is illustrated. With regard to FIG. 10, in some embodiments, the upper hammock bed 100 is attached to spreader bars 142 at the head end and foot end of the upper hammock bed 100. The upper hammock bed 100 may be attached to the spreader bars 142 using an adhesive, thread, or staples, for example. In some embodiments, cords 144 are attached at various intervals to the spreader bars 142 to suspend the hammock system between supports, such as trees, for example. The cords 144 may be attached to the spreader bars 142 using an adhesive, thread, or staples, for example. Pins 146 may also be connected to each end of the spreader bars 142. In some embodiments, the pins 146 may be attached to the spreader bars 142, such as with an adhesive, screws, or pegs, for example. In other embodiments, the pins 146 may be integrally formed with the spreader bars 142.

Figure 12:
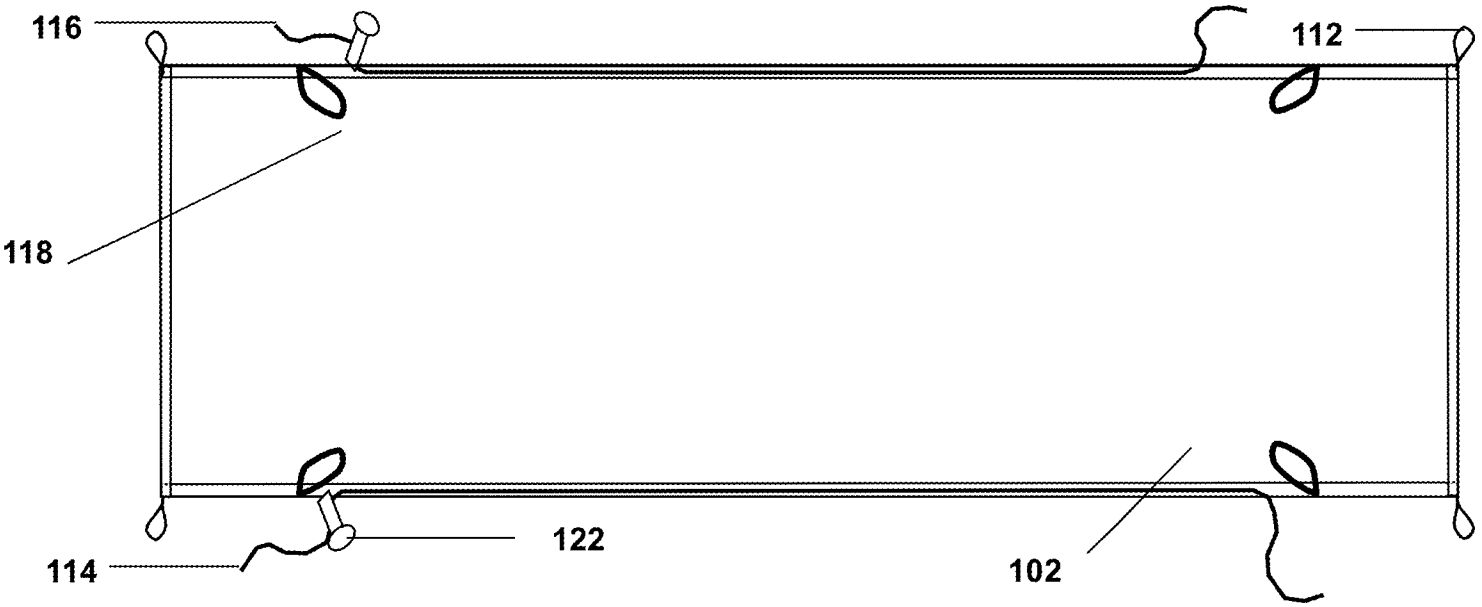
FIG. 12 is a top plan view of a lower hammock bed of the hammock system according to one example embodiment.
Figure 13:
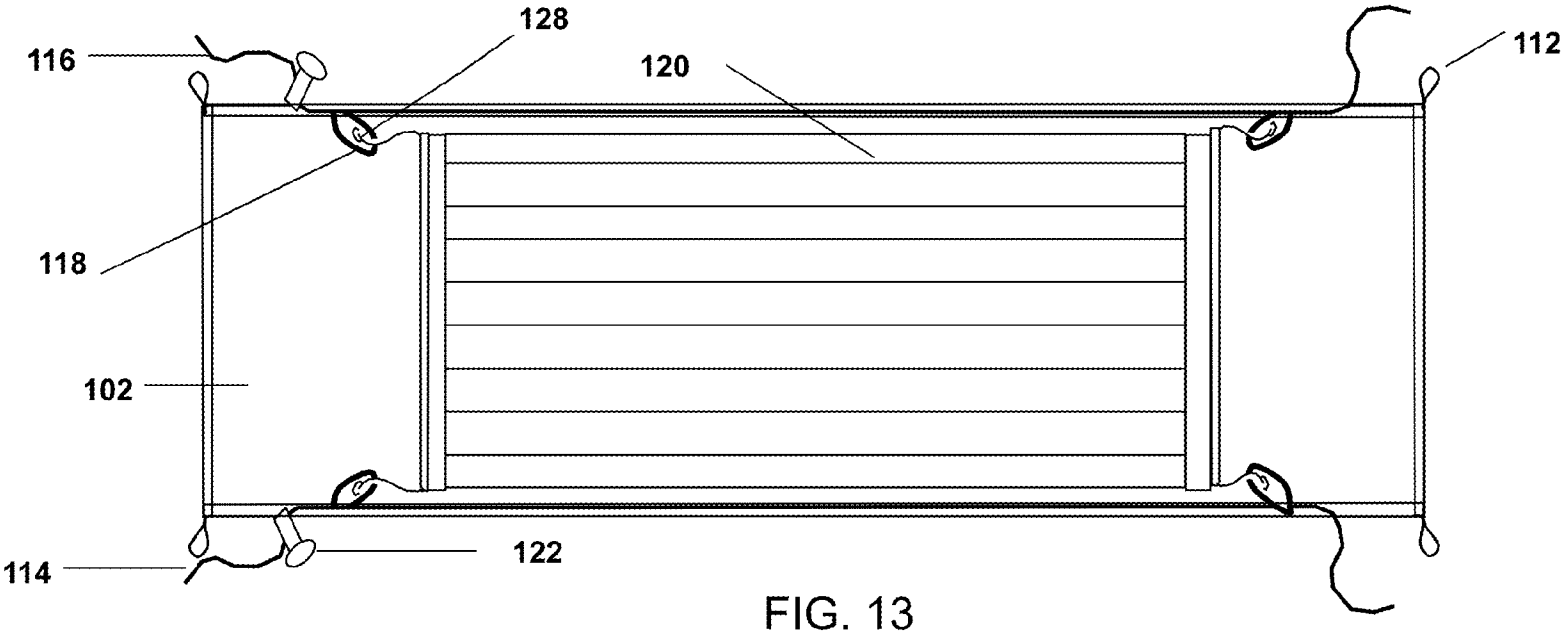
FIG. 13 is a top plan view of the lower hammock bed and a thermal insulating blanket according to one example embodiment.

Referring to FIGS. 12 and 13, a hammock attachment loop 112 on each of four corners of the lower hammock bed 102 may be used to attach the lower hammock bed 102 to the upper hammock bed. The pins 146 (shown in FIG. 10) attached on each end of the spreader bars may accommodate the hammock attachment loops 112. In some embodiments, the hammock attachment loops 112 may be attached to the lower hammock bed 102, such as with an adhesive, thread, or staples, for example. In other embodiments, the hammock attachment loops 112 may be integrally formed with the lower hammock bed 102. The hammock attachment loops 112 may be made of a strong natural or synthetic material. In some embodiments, the hammock attachment loops 112 are made from grosgrain.

Figure 14:
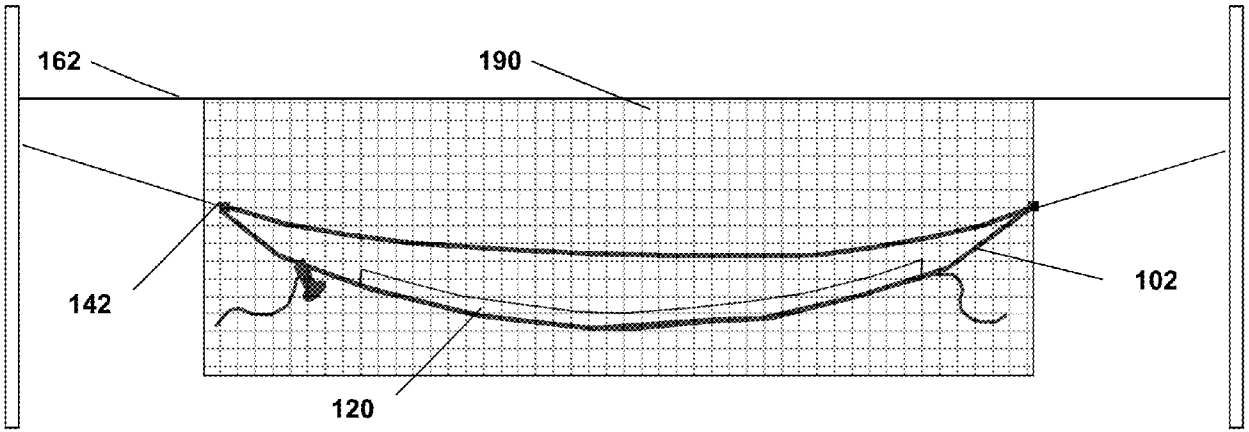
FIG. 14 is a side elevation view of a tarp of the hammock system according to one example embodiment.

With regard to FIG. 14, the optional, detachable, non-structural ridge line 162 may be added to enable a tarp 190 or mosquito net to cover the user while still providing personal space. In some embodiments, the tarp 190 may be a thin sheet of lightweight waterproof material for camping in mild rainy weather or may be insulated for camping in colder weather.

Figure 15:
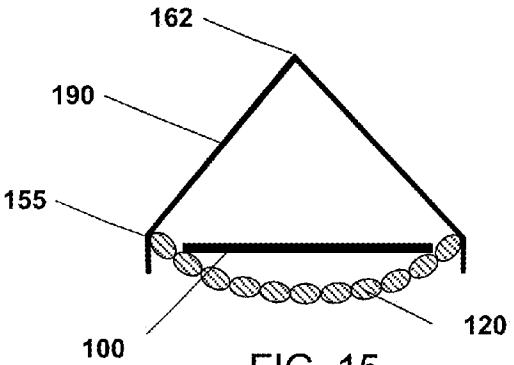
FIG. 15 is an end section view of a tarp according to one example embodiment.

As shown in FIG. 15, in some embodiments, the mosquito net or tarp 190 may be attached to the sides of the thermal insulating blanket 120 by a tarp fastener 155 to prevent wind from blowing the tarp off during inclement weather and to prevent insects from getting in the hammock system. In some embodiments, the tarp fastener 155 may be thread, staples, or an adhesive, for example. In other embodiments, the tarp fastener 155 may be made of two parts that together may be used to fasten two articles together. For example, the tarp fastener 155 may be a button and button hole, a belt and belt buckle, an eyelet and hook, two strings used to form a bow tie, ties, Velcro, a zipper, hooks, or snaps. In certain embodiments, the user may make adjustments to the tarp fastener 155 while lying in the hammock system. In some embodiments, the tarp may be joined to the thermal insulating blanket on all sides to completely enclose the user in the hammock system to keep out mosquitoes and other insects and to provide a comfortable, warm enclosure in inclement weather.

Figure 16:
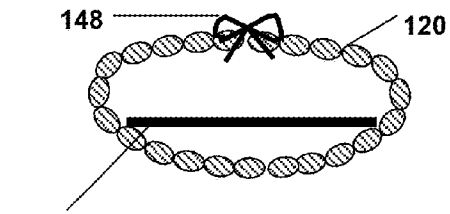
FIG. 16 is an end section view of a thermal insulating blanket according to one example embodiment.

As is illustrated in FIG. 16, a wide thermal insulating blanket 120 may be used for cold weather camping. In some embodiments, the sides of the thermal insulating blanket 120 may be pulled together using cords 148 or another type of fastener to provide additional warmth over the user. In some embodiments, the fastener may be made of two parts that together may be used to fasten two articles together. For example, the fastener may be a button and button hole, a belt and belt buckle, an eyelet and hook, two strings used to form a bow tie, ties, Velcro, a zipper, hooks, or snaps.

In some embodiments, the size of the opening between the sides of the thermal insulating blanket 120 over the user may be adjusted. In certain embodiments, the sides of the thermal insulating blanket 120 may be pulled together to completely enclose the user for maximum warmth if desired as shown in FIG. 16.

Figure 17:
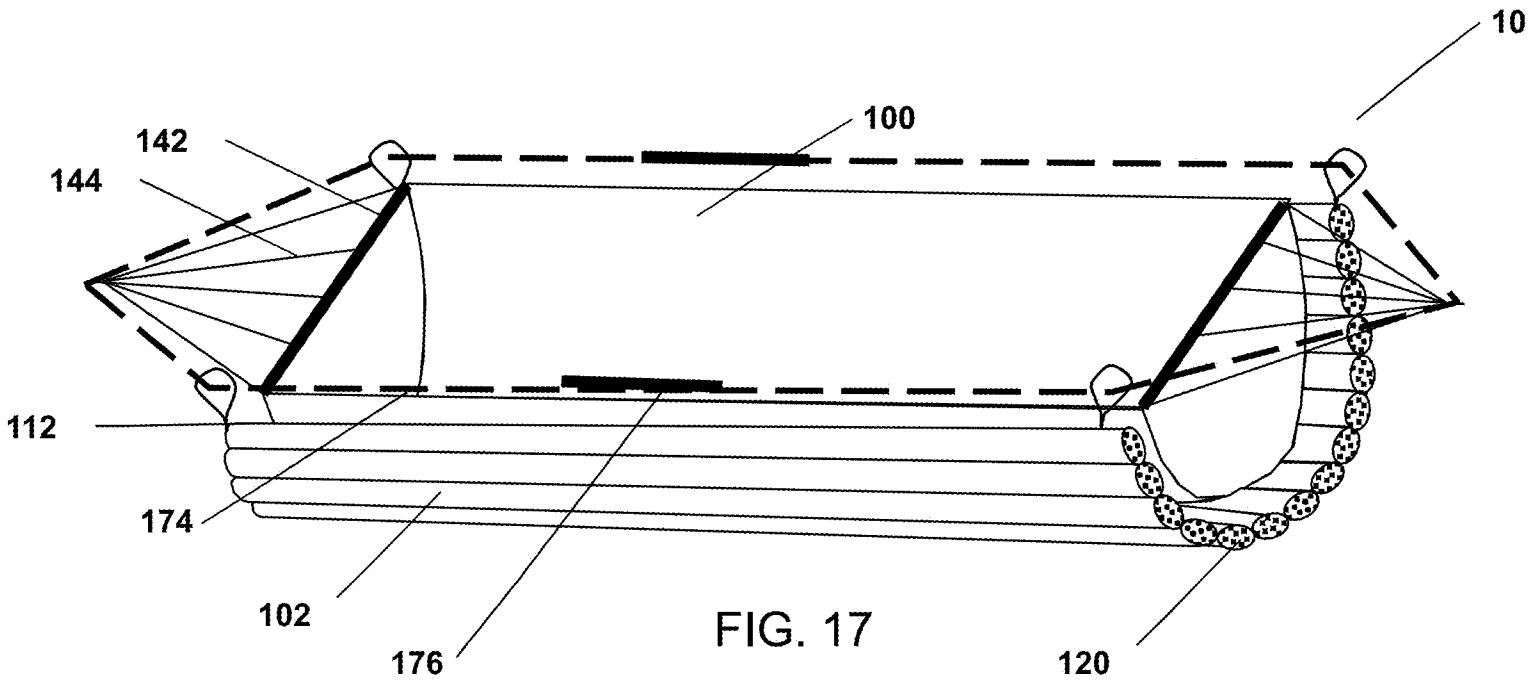
FIG. 17 is a perspective view of a hammock system according to one example embodiment.

Turning now to FIG. 17, another example embodiment of the hammock system 10 with the upper hammock bed 100, lower hammock bed 102, and thermal insulating blanket 120 is illustrated. In some embodiments, the upper hammock bed 100 may be made in a bridge hammock style. In certain embodiments, a cord suspension system 174 with a cord tension adjustment device 176 may suspend the thermal insulating blanket 120 and lower hammock bed 102 below the upper hammock bed 100. In other embodiments, pins may be attached to the ends of spreader bars 142, and hammock attachment loops 112 on the corners of the lower hammock bed 102 may be attached to the pins.

Figure 19:
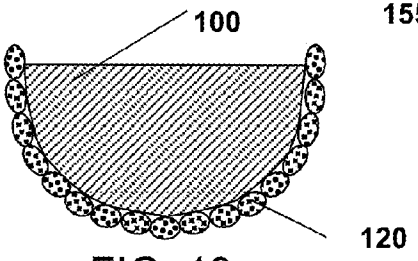
FIG. 19 is an end elevation view of an upper hammock bed, a lower hammock bed, and a thermal insulating blanket according to one example embodiment.
Figure 18:
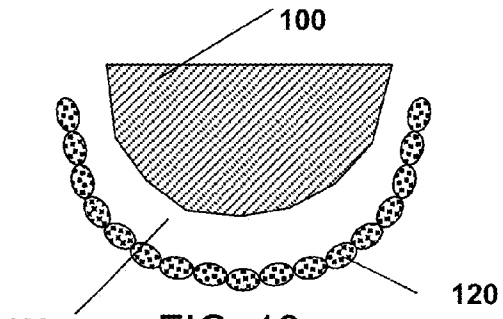
FIG. 18 is an end elevation view of an upper hammock bed, a lower hammock bed, and a thermal insulating blanket according to one example embodiment.

As illustrated in FIG. 18, tension in the cord suspension system may be relaxed to increase the size of the gap 189 between the upper hammock bed 100 and the thermal insulating blanket 120 to provide more air circulation to reduce the temperature within the hammock system. As illustrated in FIG. 19, tension in the cord suspension system may be increased to reduce the size of the gap between the upper hammock bed 100 and the thermal insulating blanket 120 to reduce the air flow and increase the temperature within the hammock system.

Figure 20:
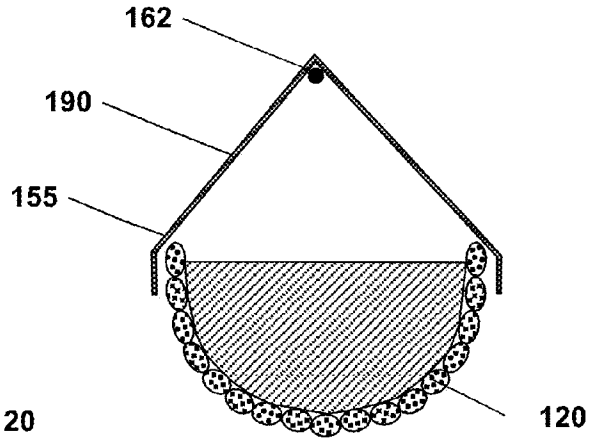
FIG. 20 is an end elevation view of an upper hammock bed, a lower hammock bed, a thermal insulating blanket, and a tarp according to one example embodiment.

With reference to FIG. 20, the optional ridge line 162 and tarp 190 or mosquito net may be added to protect the user from insects or to protect the user from inclement weather. In some embodiments, the mosquito net or tarp 190 may be attached to the sides of the thermal insulating blanket 120 by a tarp fastener 155 to prevent wind from blowing the tarp off during inclement weather and to prevent insects from getting in the hammock system. In some embodiments, the tarp fastener 155 may be thread, staples, or an adhesive, for example. In other embodiments, the tarp fastener 155 may be made of two parts that together may be used to fasten two articles together. For example, the tarp fastener 155 may be a button and button hole, a belt and belt buckle, an eyelet and hook, two strings used to form a bow tie, ties, Velcro, a zipper, hooks, or snaps. In certain embodiments, the user may make adjustments to the tarp fastener 155 while lying in the hammock system. In some embodiments, the tarp may be joined to the thermal insulating blanket on all sides to completely enclose the user in the hammock system to keep out mosquitoes and other insects and to provide a comfortable, warm enclosure in inclement weather.

Figure 21:
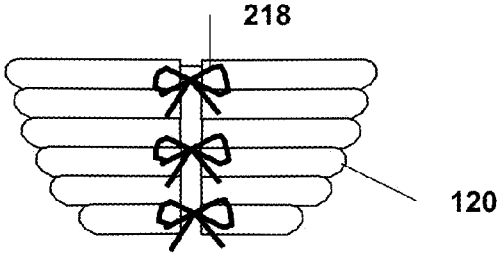
FIG. 21 is an end elevation view of a thermal insulating blanket according to one example embodiment.

As shown in FIG. 21, the thermal insulating blanket 120 may be increased in length so that the ends of a bridge style hammock may also be insulated. The ends of the thermal insulating blanket 120 may be fastened together using ties 218 or another type of fastener. In some embodiments, the fastener may be thread, staples, or an adhesive, for example. In other embodiments, the fastener may be made of two parts that together may be used to fasten two articles together. For example, the fastener may be a button and button hole, a belt and belt buckle, an eyelet and hook, two strings used to form a bow tie, ties, Velcro, a zipper, hooks, or snaps.

Figure 22:
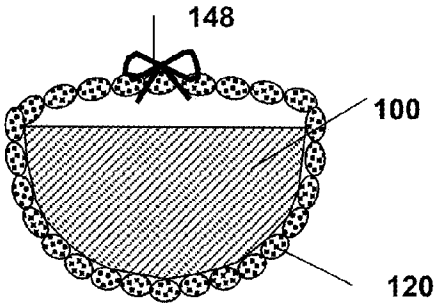
FIG. 22 is an end elevation view of an upper hammock bed, a lower hammock bed, and a thermal insulating blanket according to one example embodiment.

As shown in FIG. 22, a wide thermal insulating blanket 120 may be used for cold weather camping. In some embodiments, the sides of the thermal insulating blanket 120 may be pulled together using cords 148 or another type of fastener to provide additional warmth over the user. In some embodiments, the fastener may be made of two parts that together may be used to fasten two articles together. For example, the fastener may be a button and button hole, a belt and belt buckle, an eyelet and hook, two strings used to form a bow tie, ties, Velcro, a zipper, hooks, or snaps.

In some embodiments, the size of the opening between the sides of the thermal insulating blanket 120 over the user may be adjusted. In certain embodiments, the sides of the thermal insulating blanket 120 may be pulled together to completely enclose the user for maximum warmth if desired as shown in FIG. 22.

In use, in multiple embodiments, the lower hammock bed 102 is longer than the upper hammock bed 100 and hangs below the upper hammock bed 100, forming a gap between the lower hammock bed 102 and the thermal insulating blanket 120. Thus, the insulation in the thermal insulating blanket 120 remains uncompressed by the body weight of the user and retains its full insulating properties. The size of the gap between the lower hammock bed 102 and the thermal insulating blanket 120 may be varied with the adjuster 12. In some embodiments, the size of the gap may be varied by altering the tension in the shock cords 114 and 116 along the side edges of the lower hammock bed 102. Increasing the tension in the shock cords 114 and 116 reduces the size of the gap or eliminates the gap thus increasing warmth in the hammock system. Reducing the tension in the shock cords 114 and 116 increases the size of the gap allowing increased air flow and reducing the temperature of the user to a more comfortable level. The user may cover himself or herself with a top blanket or top quilt for additional warmth if desired.

In addition, the tension in the ends of the thermal insulating blanket may be altered with the thermal insulating blanket adjuster. In some embodiments, the tension in the ends of the thermal insulating blanket may be altered with the shock cords 125 and 126. Increasing the tension of the shock cord 125 along the head end of the thermal insulating blanket reduces air flow near the head of the user increasing warmth and reducing the tension increases air flow to increase cooling. Increasing the tension of the shock cord 126 along the foot end of the thermal insulating blanket reduces air flow near the feet of the user increasing warmth and reducing the tension increases air flow to increase cooling.

It will be appreciated that the hammock system 10 is lightweight and adjustable and reduces insulation compression. The embodiments are illustrated for hammocks, but the present invention may be applied to other similar devices, such as a sleeping cot, for example.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A hammock system, comprising:

an upper hammock bed having a length;

a lower hammock bed having a length greater than the length of the upper hammock bed, a first side, and a second side, the lower hammock bed connected to the upper hammock bed;

a thermal insulating blanket connected to the lower hammock bed;

a plurality of loops for connecting the thermal insulating blanket to the lower hammock bed, the loops connected to the lower hammock bed;

a plurality of cords connected to the thermal insulating blanket, each cord for connecting to one of the loops connected to the lower hammock bed;

a gap between the upper hammock bed and the thermal insulating blanket; and an adjuster for altering tension in the first and second sides of the lower hammock bed and altering the size of the gap between the upper hammock bed and the thermal insulating blanket, wherein the gap has a height of at least one inch when the tension in the first and second sides of the lower hammock bed is reduced and of less than one inch when the tension in the first and second sides of the lower hammock bed is increased.

2. The hammock system of claim 1, further comprising a thermal insulating blanket adjuster, wherein the thermal insulating blanket has a head end and a foot end and wherein the thermal insulating blanket adjuster is configured to alter tension in the head and foot ends of the thermal insulating blanket.

3. The hammock system of claim 2, wherein the thermal insulating blanket adjuster comprises at least one shock cord.

4. The hammock system of claim 1, wherein the thermal insulating blanket comprises a top surface, a bottom surface, baffles located between the thermal insulating blanket top and bottom surfaces, and insulation located between the thermal insulating blanket top and bottom surfaces.

5. The hammock system of claim 1, wherein the adjuster comprises at least one shock cord.

6. The hammock system of claim 1, wherein the length of the lower hammock bed is at least about 16 inches greater than the length of the upper hammock bed.

7. The hammock system of claim 1, further comprising a weather cover for protection from weather and insects.

8. The hammock system of claim 1, wherein the upper hammock bed has a head end and a foot end, wherein the lower hammock bed has a head end and a foot end, wherein the head ends of the upper and lower hammock beds are gathered and tied together, and wherein the foot ends of the upper and lower hammock beds are gathered and tied together.

* * * * *